US005907875A

United States Patent [19]

Yurchision et al.

[11] Patent Number: 5,907,875

[45] Date of Patent: Jun. 1, 1999

[54] STRUCTURAL COMPONENTS OF SWIMMING POOLS

[75] Inventors: Peter P. Yurchision, Shavertown, Pa.; Gérard Marbach, Cernay, France

[73] Assignee: Muskin Leisure Products, Inc., Wilkes-Barre, Pa.

[21] Appl. No.: 08/946,798

[22] Filed: Oct. 8, 1997

[51] Int. Cl.[6] ..... E04H 4/00

[52] U.S. Cl. ..... 4/506; 4/488

[58] Field of Search ..... 4/506, 488, 513, 4/496, 494, 504, 505

[56] References Cited

U.S. PATENT DOCUMENTS

| | | | |
|---|---|---|---|
| 1,853,090 | 4/1932 | Smiley, Jr. . | |
| 3,225,362 | 12/1965 | Barrera | 4/506 |
| 3,233,251 | 2/1966 | Berrera . | |
| 3,268,917 | 8/1966 | Diemond et al. . | |
| 3,280,408 | 10/1966 | Gersham | 4/506 |
| 3,562,822 | 2/1971 | Wall . | |
| 3,745,593 | 7/1973 | Wall . | |
| 3,877,085 | 4/1975 | Bukaitz et al. | 4/506 |
| 4,062,158 | 12/1977 | Kaufmann et al. | 4/506 |
| 4,182,087 | 1/1980 | Schall et al. . | |
| 4,413,361 | 11/1983 | Wolf et al. . | |

OTHER PUBLICATIONS

Engineering Drawing of Muskin Leisure Products, Inc. entitled "Foot Plate (6")" (originally dated Mar. 16, 1988; available to Applicant before Oct. 8, 1997).

Engineering Drawing of Muskin Leisure Products, Inc. entitled "Rim 1" 15' 51.187' LG CS" (originally dated Jan. 23, 1995; available to Applicant before Oct. 8, 1997).

*Primary Examiner*—David J. Walczak
*Attorney, Agent, or Firm*—Dean W. Russell; Kilpatrick Stockton LLP

[57] ABSTRACT

Components of swimming pools, such as rims and base plates, are addressed herein. The rims and plates are adapted for positive interlock to prevent movement of one relative to the other, and the rims typically include dual flanges of differing heights. Among base plates contemplated hereby are ones containing a slot formed by their two vertical walls and which provide guidance at their edges for positioning their associated rims.

18 Claims, 5 Drawing Sheets

STRUCTURAL COMPONENTS OF SWIMMING POOLS

FIELD OF THE INVENTION

This invention relates to structural components of swimming pools and more particularly to framing members or supports of above-ground swimming pools.

BACKGROUND OF THE INVENTION

U.S. Pat. No. 4,182,087 to Schall, et al. describes and illustrates an exemplary above-ground, essentially oval swimming pool. Made of multiple panels of extruded aluminum, the pool is designed to be built "without the necessity of a large top and bottom rail and, theoretically, without a top and bottom rail at all." As stated in the Schall, et al. patent, construction of the pool allows use of a lower guide rail "solely for the purpose of shaping" the pool. The guide rail can be removed after pool wall construction is completed or need not be used in the first place in the event that the shape of the outer pool wall has already been marked out.

Because temporary, the guide rail is not subject to forces caused by water as it fills the pool and accordingly has a simple, unslotted "L"-shaped cross section. No base plate, furthermore, is utilized in pools constructed according to the disclosure of the Schall, et al. patent.

U.S. Pat. No. 3,745,593 to Wall, by contrast, details an above-ground swimming pool in which flat base plates and "bottom rail members" are employed. Described therein is the structure of a bottom rail member, which includes a web portion having a pair of spaced apart vertical flanges integrally formed therewith and projecting upwardly therefrom. One of the vertical flanges has an inturned flange integrally formed therewith which terminates in a terminal flange. The other vertical flange projects upwardly beyond the inturned flange.

(Numerals omitted.) Defined between the inner vertical flange and the inturned flange is a slot, in which is received the lower edge of a continuous side wall preferably formed of corrugated sheet metal. No mechanism for guiding the sheet metal appears provided by the bottom rail member, however, and no positive locking means is furnished as part of the rail member itself.

Additionally described in the Wall patent is the structure of a base plate included as a part of a vertical leg support of the completed pool. Intended to be substantially flat, the base plate nonetheless has an upturned inner flange terminating in an inwardly curved upper end. A portion of the inner flange "is also struck inwardly to define a locking element . . . which is adapted to coact with the bottom rails for releasably locking the rails to the base plate." Spaced vertical guide elements of the base plate purportedly define guide ways for pairs of bottom rail members, with the inwardly curved upper end of the inner flange overlying the inner vertical flange of each bottom rail. The "inwardly struck locking element" of the base plate also "serves as a stop to limit inward movement of each pair of bottom rail members which are interconnected with each base plate." Again, however, no positive interlocking mechanism with the bottom rail members is provided, and the base plate lacks any slot for supporting a received upright or vertical leg.

SUMMARY OF THE INVENTION

The present invention, by contrast, provides a rim and base plate adapted for positive interlock. Among features of each rim of the invention is a slot in its bottom surface in which a corresponding upstanding tab of a base plate is received. The rim additionally incorporates two parallel flanged sections which collectively form an elongated slot into which a side wall is fitted. The dual flanges help increase the support provided to the side wall against the outward water pressure of the pool, while their differing heights assist in guiding the side wall into the slot during installation. Decreasing the height of one flange set additionally requires less raw material to be used in its formation.

Unlike existing base plates, moreover, those of the present invention are designed to provide sufficient support for uprights and rims notwithstanding that they may be made of resinous or other non-metallic material. This change is material in some embodiments further decreases the cost of the overall pool, and is permissible because of the novel design of the plates. In particular, base plates of the invention may include a generally semi-circular slot, formed by vertical surfaces of (typically but not necessarily) differing heights, for receiving an upright and frictionally retaining it in position. Dual tabs protruding within the plate permit its receipt of two sections of rim. Through this interlock mechanism each plate thus effectively "connects" two rim sections as the pool is installed.

Because built-up vertically, base plates of the present invention additionally provide greater guidance for the rims than do existing plates. Unlike conventional base plates, for example, which at their edges provide surfaces adjacent only one side and the bottom of the rim, those of the present invention may at their edges supply guidance surfaces adjacent not only the bottom of the rim, but adjacent both sides and most of the top as well. In other words, the guide elements of the base plate of the Wall patent, for example, are centrally located and thus initially provide no guidance for the rim as it starts to slide inward from the edge of the plate during installation. To the contrary, embodiments of the present base plate furnish such guidance at its edges. These base plates further may be designed to provide enhanced support to the bottoms of the side walls and contain holes through which any water contacting them may drain.

It is therefore an object of the present invention to provide rims, base plates, or both rims and base plates for an above-ground or other appropriate swimming pool.

It is another object of the present invention to provide a rim and base plate adapted for positive interlock to retain one in position relative to the other.

It is also an object of the present invention to provide such interlock utilizing a slot in the bottom surface of the rim in which a tab of a base plate is received.

It is a further object of the present invention to provide a rim whose dual flanges are formed so as to create both an elongated slot into which a side wall is fitted and a guide mechanism for inserting the side wall into the slot.

It is yet another object of the present invention to provide a base plate that if desired may be made of resinous or other non-metallic material.

It is an additional object of the present invention to provide a base plate including a generally semi-circular slot formed by two vertical walls and into which an upright may be received.

It is also an object of the present invention to provide a base plate which at its edges supplies enhanced guidance as a rim is inserted for retention.

Other objects, features, and advantages of the present invention will become apparent with reference to the remainder of the text and drawings of this application.

DETAILED DESCRIPTION

FIGS. 1–4 illustrate a portion of a rim 10 of the present invention. Rim 10 includes first section 14 and second section 18, which are connected by bottom 22. Rim 10 is typically made of metal, although other materials may be used instead if necessary or desired. Rim 10 additionally often is curved to enable its use in connection with oval, circular, and other non-rectangular swimming pools.

Figure 1:
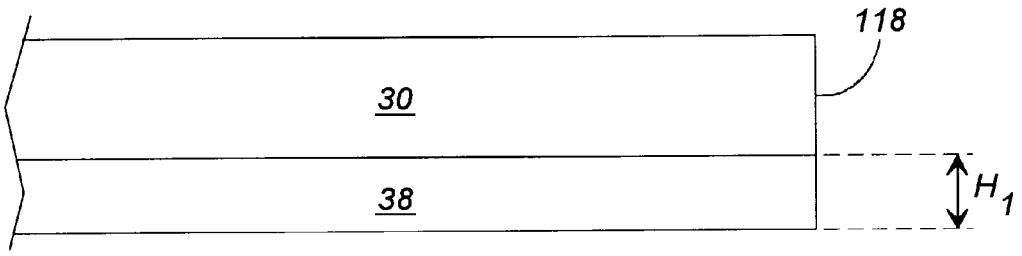
FIG. 1 is an elevational view of a (portion of a) rim of the present invention.
Figure 4:
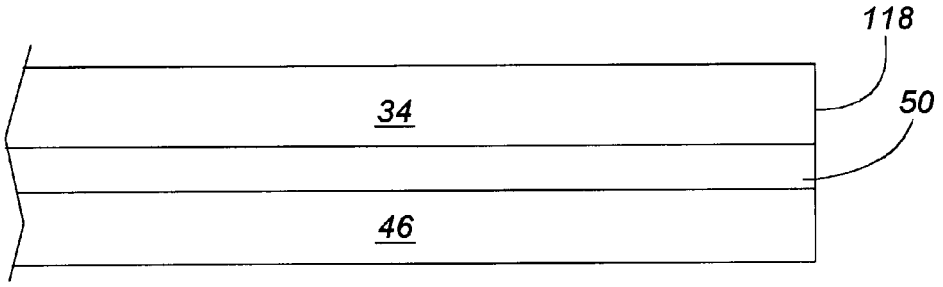
FIG. 4 is a plan view of the top of the rim of FIG. 1.
Figure 2:
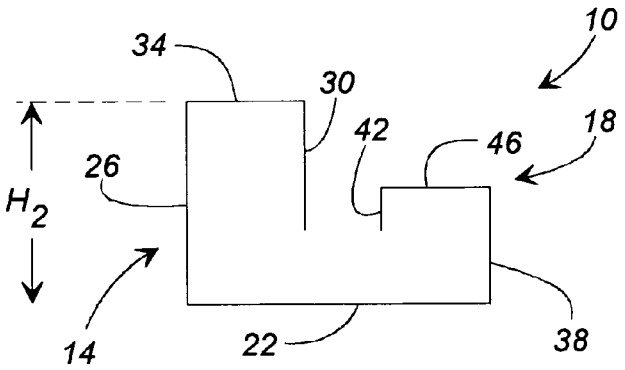
FIG. 2 is an end view of the rim of FIG. 1.

As shown in FIGS. 1–2 and 4, first section 14 comprises a substantially vertical wall 26 and a downturned flange 30 connected by a substantially horizontal face 34. Second section 18 is similarly configured, with substantially vertical wall 38 and downturned flange 42 connected by substantially horizontal face 46. Each of walls 26 and 38 and flanges 30 and 42 is (more or less) parallel to the others, with flanges 30 and 42 forming elongated slot 50 into which a side wall of a swimming pool may be fitted. Flanges 30 and 42, furthermore, effectively provide opposed surfaces for guiding the side wall into position and retaining it there against the outward water pressure of the pool. Because the height $H_1$ of wall 38 is significantly less than the height $H_2$ of wall 26, it helps prevent the side wall from "catching" on face 46 during installation; instead, the side wall is able, typically, to slide downward along flange 30 until captured within slot 50.

Figure 3:
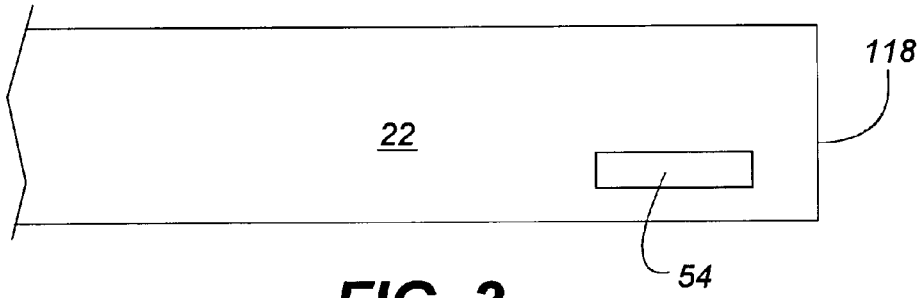
FIG. 3 is a plan view of the bottom of the rim of FIG. 1.

FIG. 3 details bottom 22 of rim 10. Bottom 22 is, generally, a flat surface, thereby assisting in levelling rim 10 (and the swimming pool) vis-a-vis the ground or other surface on which it is installed. Included, however, in segments of rim 10 is opening 54, usually (but not necessarily) in the form of an elongated slot. As described below, opening 54 functions as part of an interlock system for the framing of the swimming pool.

FIGS. 5–9 show an exemplary base plate 58 (or aspects thereof) of the present invention. Base plate 58 includes bottom 62, which usually is flat, and from which integrally-formed (dual) walls 66 and 70 upwardly protrude. As illustrated particularly in FIGS. 5–7, walls 66 and 70 are, in substantial part, semicircular, while terminating in respective straight segments 66A and 70A. Collectively walls 66 and 70 thus define a slot 74 into which a vertical support, or "upright" may be fitted, the cross-sectional shape of the upright matching that of the slot 74. If uprights of other shapes are employed walls 66 and 70 need not be substantially semicircular, but rather may assume shapes similar to those of the uprights. Like walls 26 and 38 of rim 10, walls 66 and 70 of base plate 58 have different heights, facilitating installation of the upright in a manner similar to that of the side wall of the pool.

Shown in FIGS. 6–9 are tabs 78A–B protruding upward from bottom 62 above apertures 80. In some embodiments of the invention, each tab 78 (FIG. 8) is integrally formed with bottom 62, with a generally horizontal section 82 being connected to bottom 62 by an angled section 86. Section 82 is designed to fit within and be received by opening 54, thereby forming part of the previously-mentioned interlock system for framing a swimming pool.

Figure 9:
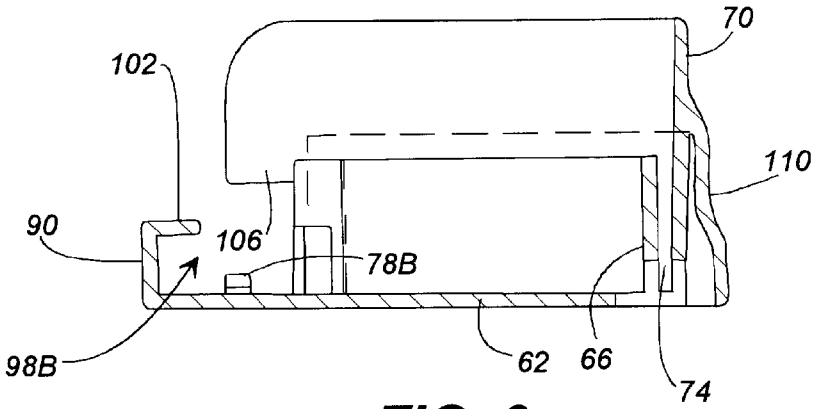
FIG. 9 is a cross-sectional view of a portion of the base plate taken along line 9—9 of FIG. 7.
Figure 5:
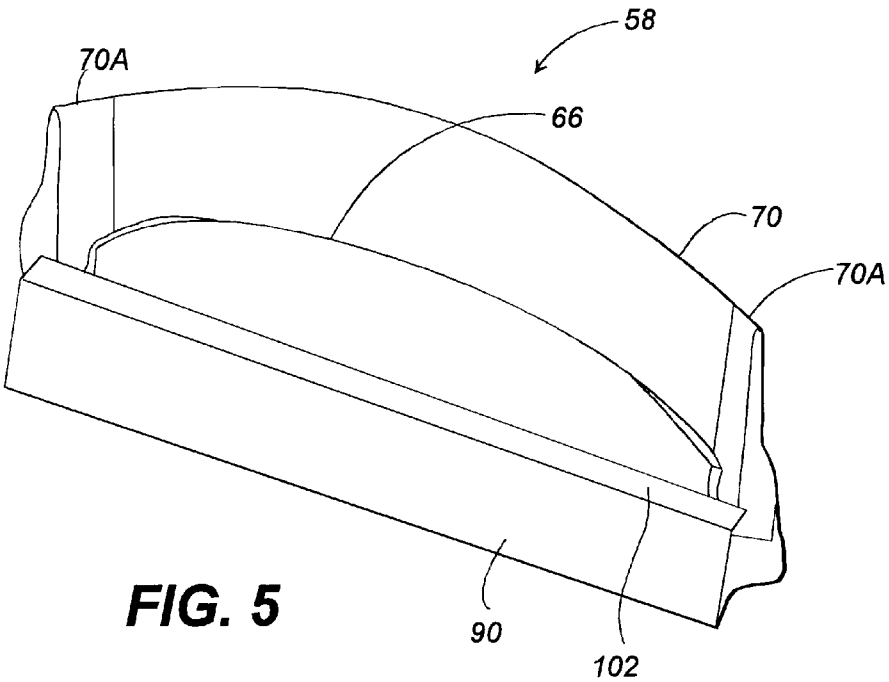
FIGS. 5 and 6 are perspective views of a base plate of the present invention.
Figure 6:
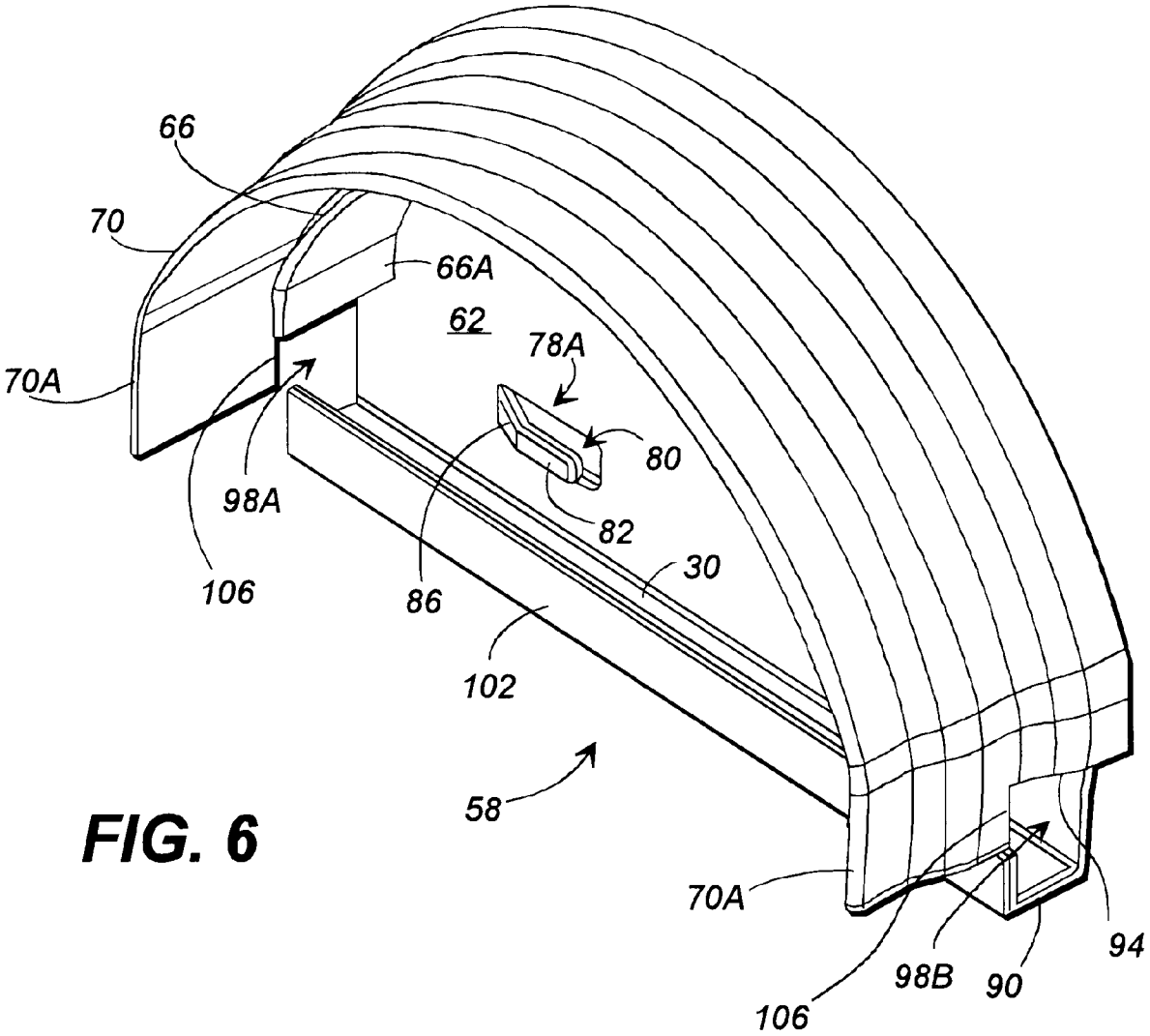
Figure 7:
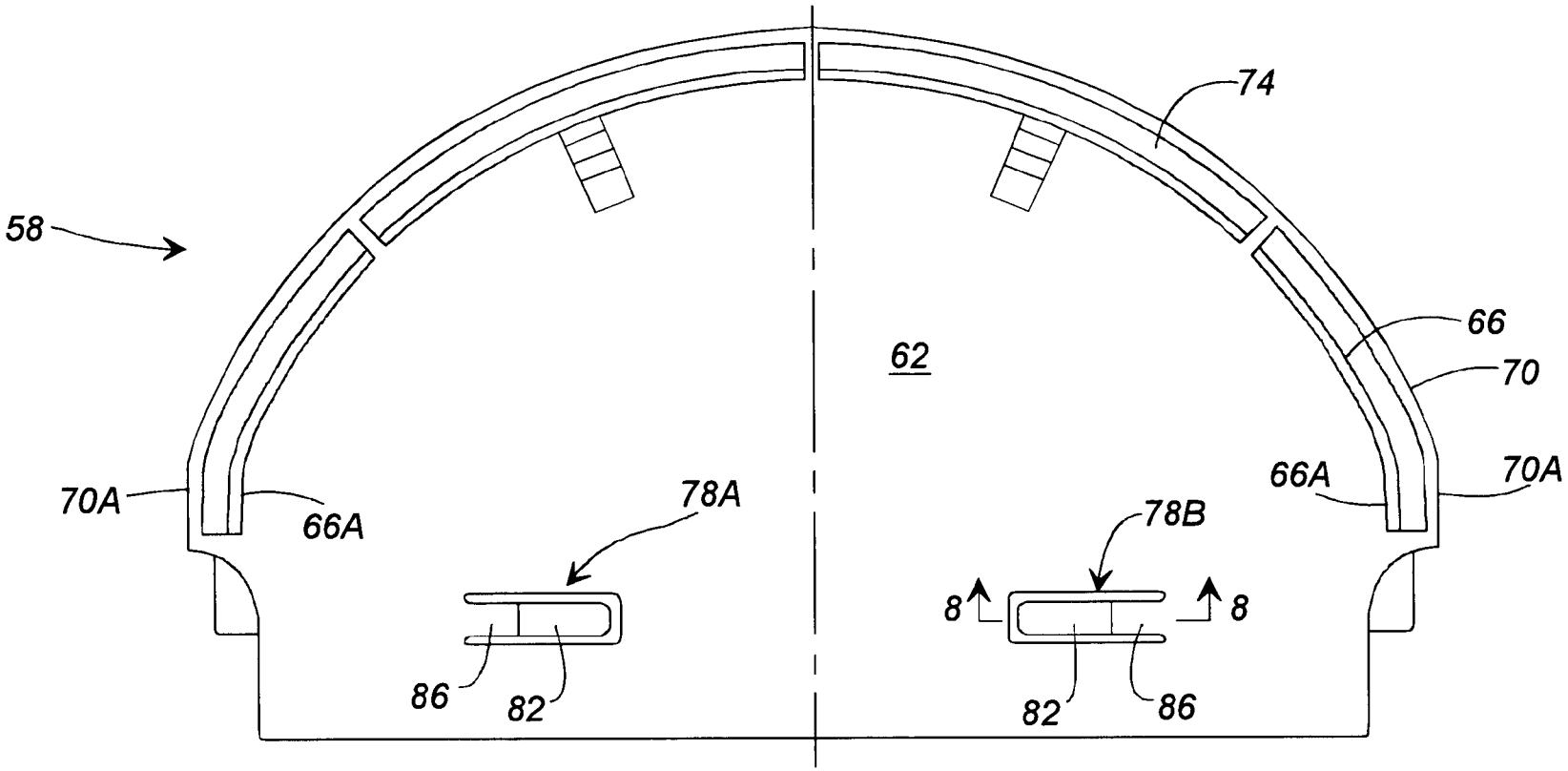
FIG. 7 is a top view of the base plate of FIGS. 5–6.
Figure 8:
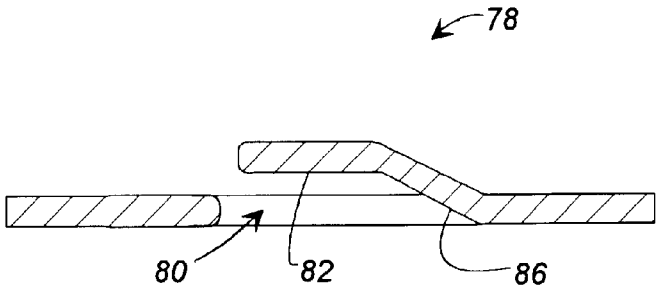
FIG. 8 is a cross-sectional view of a portion of the base plate taken along line 8—8 of FIG. 7.

Illustrated especially in FIG. 9 is guide wall 90, which assists in receiving and appropriately positioning a rim 10 within base plate 58. Together with bottom 62 and edge 94 of wall 70, guide wall 90 defines three-quarters of an opening 98A of base plate 58 into which rim 10 may be fitted. Lip 102 (integrally formed with guide wall 90) and overhang 106 of wall 70 define the remainder of opening 98A, with edges of lip 102 and overhang 106 being spaced approximately (or slightly larger than) the width of slot 50. The distance between lip 102 and bottom 62 is approximately (or slightly larger than) $H_1$, while that between overhang 106 and bottom 62 is approximately (or slightly larger than) $H_2$. To accommodate some curvature of rim 10, opening 98A preferably is slightly wider than bottom 22 of the rim 10. Opening 98A nonetheless is approximately the cross-sectional shape and size of rim 10, however, providing substantial guidance as the rim 10 is inserted through it. A second opening 98B likewise is present in base plate 58 for receiving another section of rim 10.

Additionally detailed in FIG. 9 is the built-up status of wall 70. Included as part of wall 70 in some embodiments of base plate 58 is undulating supplement 110, which functions as a flange for or other strengthener of the base plate 58. In particular, including supplement 110 helps prevent wall 70 from breaking based on the outward water pressure presented to the upright from within the pool.

Typically, for installation base plates 58 are positioned atop blocks buried in the ground. Optimal results are achieved for some uses of base plates 58 when they are placed atop buried blocks whose upper surfaces are flush with the ground. In other words, bottom 62 of base plate 58 usually is level with the ground on which the swimming pool is being installed, effectively providing a footing for an upright of the pool.

Figure 10:
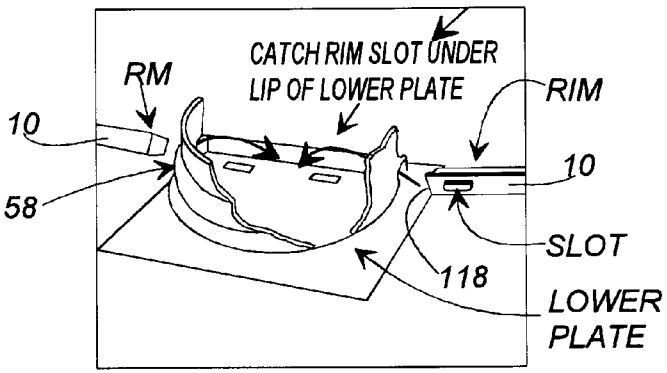
FIG. 10 is a perspective, partially cut-away view illustrating interconnection of sections of a rim and a base plate of the present invention.

After appropriately positioning a base plate 58, the consumer may use it to connect two sections of rim 10 (FIG. 10). End 118 of rim 10 initially is passed through opening 98A (oriented so that face 34 is underneath overhang 106 and face 46 is underneath lip 102), so that bottom 22 of rim 10 depresses tab 78A. As additional portions of rim 10 pass through opening 98A, opening 54 ultimately passes over tab 78A, whose section 82 springs into and is thus received by opening 54, effectively locking rim 10 in place relative to base plate 58. Similarly, another section of rim 10 may be passed through opening 98B until its opening 54 receives section 82 of tab 78B.

Figure 11:
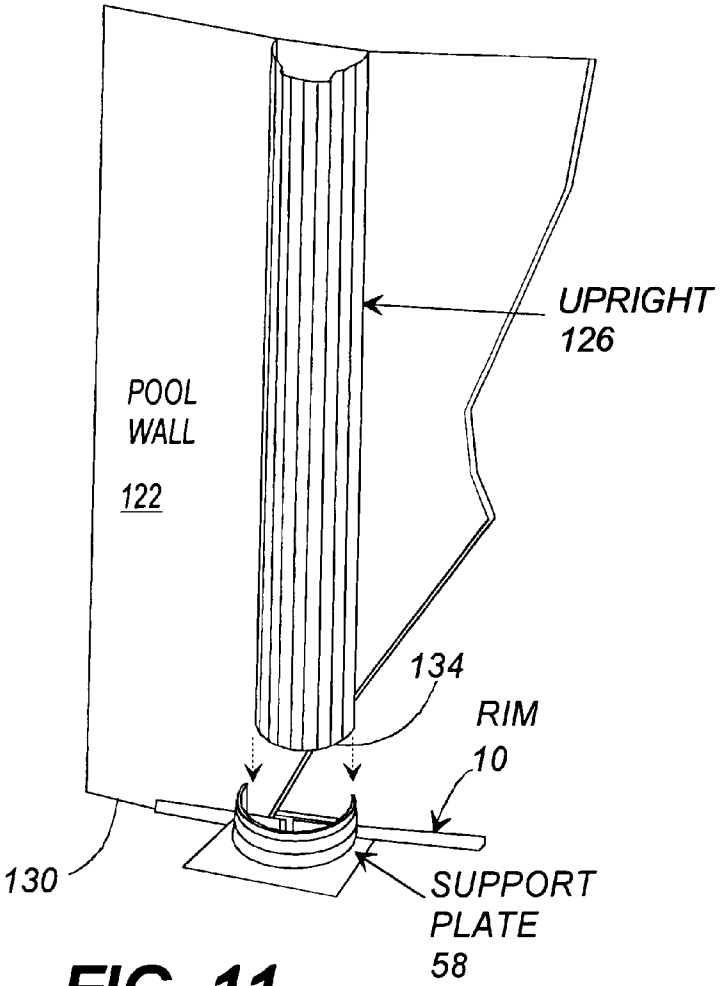
FIG. 11 is a perspective view illustrating placement of a side wall and upright within, respectively, sections of the rim and base plate of FIG. 10.

As shown in FIG. 11, following placement of sections of rim 10, side wall 122 and upright 126 may be installed. The lower edge 130 of side wall 122 fits within slot 50 defined by the sections of rim 10, while lower edge 134 of upright 126 fits within slot 74 of base plate 58. As designed, neither side wall 122 nor upright 126 need be bolted or otherwise fastened to rim 10 or base plate 58, although any suitable fastening system may be employed to enhance the footing provided by these components when necessary or desired.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A footing for a swimming pool having a side wall and an upright, comprising:

a. a base plate comprising:
  i. a bottom;
  ii. first and second walls extending upward from the bottom and defining a slot for receiving the upright; and
  iii. a tab integrally formed with and extending upward from the bottom; and b. a rim comprising:
  i. a bottom defining an opening for receiving the tab; and
  ii. first and second sections defining a slot for receiving the side wall.

2. A footing according to claim 1 in which each of the first and second walls of the base plate has a component of semi-circular shape.

3. A footing according to claim 1 in which the tab a. a substantially horizontal section adapted to be received by the opening in the bottom of the rim; and b. an angled section connecting the substantially horizontal section to the bottom of the base plate.

4. A footing according to claim 1 in which:

a. the first wall of the base plate defines an overhang;

b. the base plate further comprises a guide wall extending upward from the bottom and terminating in a lip; and c. the overhang, bottom, guide wall, and lip define an opening in the base plate through which the rim is adapted to pass.

5. A footing according to claim 1 in which the base plate is made of non-metallic material and the rim is made of metal.

6. A footing according to claim 1 in which:

a. the first section of the rim comprises:
  i. a substantially vertical wall connected to the bottom and of selected height H;
  ii. a downturned flange; and
  iii. a substantially horizontal face connecting the substantially vertical wall and downturned flange; and b. the second section of the rim comprises:
  i. a substantially vertical wall connected to the bottom and of height less than H;
  ii. a downturned flange; and
  iii. a substantially horizontal face connecting the substantially vertical wall and downturned flange.

7. A footing for a swimming pool having a side wall and an upright, comprising:

a. a base plate comprising:
  i. a bottom;
  ii. first and second walls extending upward from the bottom, having components of semi-circular shape, and defining a slot for receiving the upright, the first wall further defining an overhang;
  iii. a tab integrally formed with and extending upward from the bottom and comprising:
    A. a substantially horizontal section; and
    B. an angled section connecting the substantially horizontal section to the bottom; and
  iv. a guide wall extending upward from the bottom and terminating in a lip; and b. a rim comprising:
  i. a bottom defining an opening for receiving the tab; and
  ii. first and second sections defining a slot for receiving the side wall, the first section comprising:
    A. a substantially vertical wall connected to the bottom and of selected height H;
    B. a downturned flange; and
    C. a substantially horizontal face connecting the substantially vertical wall and downturned flange; and the second section comprising:
    A. a substantially vertical wall connected to the bottom and of height less than H;
    B. a downturned flange; and
    C. a substantially horizontal face connecting the substantially vertical wall and downturned flange; and in which (1) the substantially horizontal section of the tab is adapted to be received by the opening in the bottom of the rim and (2) the overhang, bottom of the plate, guide wall, and lip define an opening in the base plate through which the rim is adapted to pass.

8. A base plate adapted to receive an upright of a swimming pool, comprising:

a. a bottom;

b. first and second walls extending upward from the bottom and defining a slot for receiving the upright; and c. a tab integrally formed with and extending upward from the bottom and which comprises:
  i. a substantially horizontal section; and
  ii. an angled section connecting the substantially horizontal section to the bottom.

9. A base plate according to claim 8 in which each of the first and second walls has a component of semi-circular shape.

10. A base plate according to claim 8 further comprising a second tab extending upward from the bottom and in which the first wall defines an overhang.

11. A base plate according to claim 10 further comprising a guide wall extending upward from the bottom and terminating in a lip, the overhang, bottom, guide wall, and lip defining an opening at an edge of the base plate.

12. A base plate according to claim 11 further comprising a flange supplementing the strength of the first wall.

13. A rim adapted to receive a side wall of a swimming pool, comprising:

a. a bottom;

b. a first section comprising:
  i. a substantially vertical wall connected to the bottom and of selected height H;
  ii. a downturned flange; and
  iii. a substantially horizontal face connecting the substantially vertical wall and downturned flange; and c. a second section comprising:
  i. a substantially vertical wall connected to the bottom and of height less than H;
  ii. a downturned flange; and
  iii. a substantially horizontal face connecting the substantially vertical wall and downturned flange.

14. A rim according to claim 13 in which the first and second sections define a slot for receiving the side wall.

15. A rim adapted to receive a side wall of a swimming pool, comprising:

a. a bottom defining means for interlocking with a base plate of the swimming pool;

b. a first section comprising:

i. a substantially vertical wall connected to the bottom and of selected height H;

ii. a downturned flange; and iii. a substantially horizontal face connecting the substantially vertical wall and downturned flange; and c. a second section comprising:

i. a substantially vertical wall connected to the bottom and of height less than H;

ii. a downturned flange; and iii. a substantially horizontal face connecting the substantially vertical wall and downturned flange.

16. A rim according to claim 15 in which the interlocking means comprises an opening.

17. A footing for a swimming pool having a side wall and an upright, comprising:

a. a base plate comprising:

i. a bottom;

ii. first and second walls extending upward from the bottom and defining a slot for receiving the upright, the first wall defining an overhang;

iii. a tab extending upward from the bottom; and iv. a guide wall extending upward from the bottom and terminating in a lip; and b. a rim comprising:

i. a bottom defining an opening for receiving the tab; and ii. first and second sections defining a slot for receiving the side wall; and in which the overhang, bottom, guide wall, and lip define an opening in the base plate through which the rim is adapted to pass.

18. A footing for a swimming pool having a side wall and an upright, comprising:

a. a base plate comprising:

i. a bottom;

ii. first and second walls extending upward from the bottom and defining a slot for receiving the upright; and iii. a tab extending upward from the bottom; and b. a rim comprising:

i. a bottom defining an opening for receiving the tab; and ii. first and second sections defining a slot for receiving the side wall, each of the first and second sections comprising:

a. a substantially vertical wall connected to the bottom;

b. a downturned flange; and c. a substantially horizontal face connecting the substantially vertical wall and downturned flange; and in which the substantially vertical wall of the first section is of selected height H and the substantially vertical wall of the second section is of height less than H.

* * * * *

UNITED STATES PATENT AND TRADEMARK OFFICE

CERTIFICATE OF CORRECTION

PATENT NO. : 5,907,875
DATED : June 1, 1999
INVENTOR(S) : Peter P. Yurchision, et al.

It is certified that error appears in the above-indentified patent and that said Letters Patent is hereby corrected as shown below:

column 5, line 28, after "tab" insert --comprises-- --

Signed and Sealed this

Fourteenth Day of December, 1999

*Attest:*

Q. TODD DICKINSON

*Attesting Officer*

*Acting Commissioner of Patents and Trademarks*